US009352479B2

(12) United States Patent
Walker et al.

(10) Patent No.: US 9,352,479 B2
(45) Date of Patent: May 31, 2016

(54) LATTICE CUTTING MACHINE SYSTEM

(71) Applicant: J.R. Simplot, Boise, ID (US)

(72) Inventors: David Bruce Walker, Meridian, ID (US); Allen J. Neel, Nampa, ID (US); David Campion, Boise, ID (US); Jason Boyd, Boise, ID (US); Travis Deleve, Boise, ID (US); Wayne Vogen, Santa Cruz, CA (US)

(73) Assignee: J.R. Simplot Company, Boise, ID (US)

( * ) Notice: Subject to any disclaimer, the term of this patent is extended or adjusted under 35 U.S.C. 154(b) by 390 days.

(21) Appl. No.: 13/837,753

(22) Filed: Mar. 15, 2013

(65) Prior Publication Data

US 2013/0205965 A1 Aug. 15, 2013

Related U.S. Application Data

(63) Continuation-in-part of application No. 13/341,911, filed on Dec. 31, 2011, now Pat. No. 8,844,416.

(51) Int. Cl.

| | |
|---|---|
| ***B26D 7/06*** | (2006.01) |
| ***B26D 1/143*** | (2006.01) |
| ***B26D 1/00*** | (2006.01) |

(Continued)

(52) U.S. Cl.

CPC ..... *B26D 7/0658* (2013.01); *B26D 1/0006* (2013.01); *B26D 1/143* (2013.01); *B26D 1/29* (2013.01); *B26D 1/45* (2013.01); *B26D 1/60* (2013.01); *B26D 2001/006* (2013.01); *Y10T 83/2066* (2015.04); *Y10T 83/2098* (2015.04); *Y10T 83/2209* (2015.04); *Y10T 83/8791* (2015.04)

(58) Field of Classification Search

CPC ..... B26D 7/0658; B26D 1/45; B26D 1/0006; B26D 1/12; B26D 1/14; B26D 1/143; B26D 1/157; B26D 1/20; B26D 1/24; B26D 1/29; B26D 2001/006; B26D 1/60; Y10T 83/8791; Y10T 83/2009

See application file for complete search history.

(56) References Cited

U.S. PATENT DOCUMENTS 773,483 A * 10/1904 Drew ..... B02C 13/26 241/244

898,109 A * 9/1908 Hottman ..... B26D 1/29 241/92

(Continued)

OTHER PUBLICATIONS

Illustrated Sourcebook of Mechanical Components, Robert O. Parmley, P.E., McGraw-Hill, Copyright 2000, pp. 4-52-4-55.*

(Continued)

*Primary Examiner* — Sean Michalski
*Assistant Examiner* — Jonathan Riley
(74) *Attorney, Agent, or Firm* — Parson Behle & Latimer

(57) ABSTRACT

A cutting machine for cutting a vegetable product includes a frame, supporting a product flow path, at least three links, pivotally attached to the frame, a cutting plate, pivotally attached to each of the three links at three pivot points and oriented substantially perpendicular to the flow path, a plurality of cutting knives, carried by the cutting plate, each having a generally corrugated configuration defining adjacent peaks and troughs, the cutting knives oriented angularly with respect to each other, and a drive motor, coupled to rotationally drive at least one of the links with respect to the frame, whereby the cutting plate moves in an orbital motion in a plane substantially perpendicular to the flow path, thereby moving the cutting knives sequentially and repeatedly across the product flow path.

13 Claims, 11 Drawing Sheets

(51) Int. Cl.

| | |
|---|---|
| ***B26D 1/29*** | (2006.01) |
| ***B26D 1/45*** | (2006.01) |
| *B26D 1/60* | (2006.01) |

(56) References Cited

U.S. PATENT DOCUMENTS

| | | | | | |
|---|---|---|---|---|---|
| 1,150,969 | A | * | 8/1915 | Rudnicki | B26D 1/143 83/591 |
| 2,024,353 | A | * | 12/1935 | Goodman, Jr. | B26D 1/29 144/162.1 |
| 2,712,842 | A | * | 7/1955 | Fahrni | B27L 11/02 144/162.1 |
| 3,139,127 | A | | 6/1964 | Urschel et al. | |
| 3,139,130 | A | | 6/1964 | Urschel et al. | |
| 3,217,768 | A | | 11/1965 | Lamb | |
| 3,623,525 | A | * | 11/1971 | Kieves | B26D 1/29 241/292.1 |
| 4,135,002 | A | | 1/1979 | Hodges et al. | |
| 4,367,667 | A | * | 1/1983 | Shibata | B26D 3/22 241/92 |
| 4,420,494 | A | | 12/1983 | Glantz | |
| 4,451,444 | A | | 5/1984 | Santillie et al. | |
| 4,456,624 | A | | 6/1984 | Glantz et al. | |
| 4,487,786 | A | | 12/1984 | Junge | |
| 4,514,959 | A | | 5/1985 | Shroyer | |
| 4,523,503 | A | | 6/1985 | Julian et al. | |
| 4,542,821 | A | | 9/1985 | Livermore | |
| 4,559,232 | A | | 12/1985 | Glantz et al. | |
| 4,576,071 | A | | 3/1986 | Rayment | |
| 4,618,470 | A | | 10/1986 | Salisbury | |
| 4,626,438 | A | | 12/1986 | Glantz | |
| 4,629,017 | A | | 12/1986 | Shroyer | |
| 4,632,838 | A | | 12/1986 | Doenges | |
| 4,644,838 | A | | 2/1987 | Samson et al. | |
| 4,656,904 | A | | 4/1987 | Rayment et al. | |
| 4,843,795 | A | | 7/1989 | Shroyer | |
| 4,926,726 | A | | 5/1990 | Julian | |
| 4,937,084 | A | * | 6/1990 | Julian | B26D 1/03 426/144 |
| 4,955,178 | A | | 9/1990 | Shroyer | |
| 4,979,418 | A | | 12/1990 | Covert et al. | |
| 5,000,569 | A | | 3/1991 | Nylund | |
| 5,009,141 | A | | 4/1991 | Julian et al. | |
| 5,042,342 | A | | 8/1991 | Julian | |
| 5,059,435 | A | | 10/1991 | Sloan et al. | |
| 5,084,291 | A | | 1/1992 | Burrows et al. | |
| 5,141,759 | A | | 8/1992 | Sloan et al. | |
| 5,174,181 | A | | 12/1992 | Julian et al. | |
| 5,191,819 | A | * | 3/1993 | Hoshi | B26D 1/035 83/349 |
| 5,201,259 | A | | 4/1993 | Covert et al. | |
| 5,211,098 | A | | 5/1993 | Mendenhall | |
| 5,211,278 | A | | 5/1993 | Mendenhall | |
| 5,296,252 | A | | 3/1994 | Mendenhall | |
| 5,343,791 | A | | 9/1994 | Julian et al. | |
| 5,394,793 | A | | 3/1995 | Julian et al. | |
| 5,753,291 | A | | 5/1998 | Pederson et al. | |
| 5,818,953 | A | | 10/1998 | Queisser et al. | |
| 5,905,440 | A | | 5/1999 | Julian et al. | |
| 5,992,284 | A | * | 11/1999 | Bucks | B26D 1/0006 83/663 |
| 6,136,358 | A | | 10/2000 | Minelli et al. | |
| 6,148,702 | A | * | 11/2000 | Bucks | B26D 1/0006 83/110 |
| 6,514,554 | B1 | | 2/2003 | Minelli et al. | |
| 7,178,440 | B2 | * | 2/2007 | Bucks | B26D 1/29 83/591 |
| 7,430,947 | B2 | | 10/2008 | Julian et al. | |
| D581,627 | S | | 12/2008 | Young et al. | |
| 7,560,128 | B2 | | 7/2009 | Sloan | |
| 7,628,106 | B2 | | 12/2009 | Pack et al. | |
| 7,721,637 | B2 | * | 5/2010 | Bucks | B26D 1/0006 83/349 |
| 7,748,303 | B2 | | 7/2010 | Julian et al. | |
| 7,789,000 | B2 | | 9/2010 | Julian et al. | |
| 7,849,771 | B2 | | 12/2010 | Julian et al. | |
| 8,156,851 | B2 | | 4/2012 | Julian et al. | |
| 8,347,511 | B2 | | 1/2013 | Young et al. | |
| 8,844,416 | B2 | * | 9/2014 | Walker | B26D 1/0006 83/402 |
| 2003/0121422 | A1 | | 7/2003 | Mendenhall | |
| 2003/0145698 | A1 | * | 8/2003 | Bucks | B26D 7/0658 83/13 |
| 2005/0092194 | A1 | | 5/2005 | Bajema et al. | |
| 2005/0279228 | A1 | | 12/2005 | Julian et al. | |
| 2009/0202694 | A1 | | 8/2009 | Julian et al. | |
| 2009/0255391 | A1 | * | 10/2009 | Hood | B26D 3/283 83/648 |
| 2012/0167737 | A1 | | 7/2012 | Walker et al. | |

OTHER PUBLICATIONS

International Searching Authority; ISR-WO for PCT/US2014/028994 dtd Aug. 8, 2014.

New Zealand Intellectual Property Office; First Examination Report for NZ IP No. 711820, dated Nov. 18, 2015.

Australian Government Intellectual Property Office; Patent Examination Report No. 1 Issued in Australian Patent Application No. 2014229015; dated Feb. 10, 2016.

* cited by examiner

LATTICE CUTTING MACHINE SYSTEM

PRIORITY CLAIM

The present application is a continuation-in-part of U.S. patent application Ser. No. 13/341,911, filed on Dec. 31, 2011 and entitled LATTICE CUTTING MACHINE, the disclosure of which is incorporated herein by reference in its entirety.

BACKGROUND

1. Field of the Invention

This invention relates generally to improvements in devices and methods for cutting food products such as potatoes, into lattice or waffle-cut slices. More particularly, this invention relates to a lattice cutting or slicing machine for cutting a succession of potatoes or the like traveling along a flow path into lattice or waffle-cut slices, and a system for selectively or simultaneously employing multiple such slicing machines in parallel.

2. Related Art

Potato slices having a variety of shapes, such as having a lattice or waffle-cut geometry, have become popular food products. Lattice or waffle-cut potato slices are characterized by corrugated cut patterns on opposite sides of each slice. The opposing cut patterns are angularly oriented relative to each other, such as at approximately right angles. It is desirable that the troughs or valleys of the opposing corrugated cut patterns are sufficiently deep to partially intersect one another, resulting in a potato slice having a generally rectangular grid configuration with a repeating pattern of small through openings. Relatively thin lattice-cut slices of this type can be processed to form lattice-cut potato chips. Thicker lattice cut slices are typically processed by par frying and/or finish frying to form lattice-cut or waffle-cut French fries.

Slicing machines have been developed for production cutting of potatoes and other food products into lattice-cut slices or other shapes, such as crinkle-cut, etc. These machines differ in many respects from more conventional cutting machines. For example, straight-cut French fry slices are typically cut by means of a so-called water knife, which can have a very high throughput rate. The speed of lattice-cut and other slicing machines, on the other hand, is generally slower, and often causes users to employ several such machines in parallel to meet consumer demand. As a result, the capital equipment cost tends to be relatively high. There are also some possible failure modes of some lattice cutting machines that are desirable to avoid.

The present disclosure is directed toward one or more of the above issues.

SUMMARY

It has been recognized that it would be advantageous to develop a lattice cutting machine that can rapidly and consistently cut potatoes and the like propelled along an hydraulic flow path into lattice or waffle-cut slices of selected slice thickness.

It has also been recognized that it would be advantageous to have a lattice cutting machine that is affordable and easy to use.

In accordance with one embodiment thereof, the present invention provides a cutting machine for cutting a vegetable product. The cutting machine includes a frame, supporting a product flow path, at least three links, pivotally attached to the frame, and a cutting plate, pivotally attached to each of the three links at three pivot points and oriented substantially perpendicular to the flow path. A plurality of cutting knives are carried by the cutting plate, each having a generally corrugated configuration defining adjacent peaks and troughs, the cutting knives oriented angularly with respect to each other. The cutting machine also includes a drive motor, coupled to rotationally drive at least one of the links with respect to the frame, whereby the cutting plate moves in an orbital motion in a plane substantially perpendicular to the flow path, thereby moving the cutting knives sequentially and repeatedly across the product flow path.

In accordance with another aspect thereof, the invention provides a cutting plate for cutting vegetables. The cutting plate includes a plurality of cutting blades, disposed radially upon the cutting plate, each cutting blade having a corrugated cutting profile and configured to cut a vegetable slice with a pattern of adjacent peaks and troughs. A corresponding plurality of slots are disposed adjacent to each cutting blade, the slots configured to allow the vegetable slice to pass through after being cut by one of the plurality of cutting blades. The cutting plate also includes a plurality of rotatable links, configured to link the cutting plate to a driving device that rotates the cutting plate in an orbital motion adjacent to a cutting position for the vegetables.

In accordance with yet another aspect thereof, the invention provides a system for cutting vegetable products. The system includes a transport system, having an outlet, configured for transporting vegetable products in single file toward the outlet, a plurality of vegetable cutting machines, a collection system, disposed downstream of the vegetable cutting machines, configured to collect the vegetables after cutting, and a selection device, configured to selectively couple the outlet of the transport system to one or more of the vegetable cutting machines.

In accordance with still another aspect thereof, the invention provides a cutting machine for cutting vegetables. The cutting machine includes a product flow path, a cutting plate, and four cutting knives disposed on the cutting plate. The product flow path is configured to direct the vegetables to a cutting position and the cutting plate is pivotally mounted upon three rotatable links and oriented generally perpendicular to the product flow path. The four cutting knives are disposed upon the cutting plate at approximately 90° intervals and oriented substantially perpendicular with respect to each adjacent cutting knife. Each of the cutting knives includes a generally corrugated configuration defining adjacent peaks and troughs, an upstream side, having a recessed ramp for guiding the vegetables into cutting engagement with the cutting knife, and a downstream side, having a slot for passage of each cut slice therethrough after cutting. The system also includes means for rotationally driving at least one of the links, thereby driving the cutting plate in an orbital path generally perpendicular to the flow path, whereby the cutting knives sequentially and repeatedly move across the cutting position and into cutting engagement with the vegetables to form vegetable slices having a generally corrugated cut shape.

BRIEF DESCRIPTION OF THE DRAWINGS

Additional features and advantages of the invention will be apparent from the detailed description which follows, taken in conjunction with the accompanying drawings, which together illustrate, by way of example, features of the invention, and wherein.

DETAILED DESCRIPTION

Figure 1:
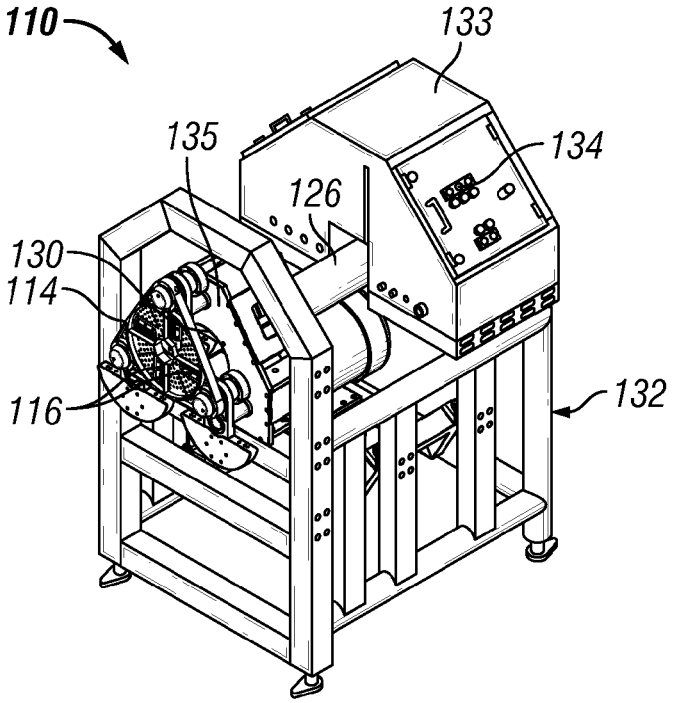
FIG. 1 is a front perspective view of an embodiment of a lattice cutting machine in accordance with the present disclosure.

Reference will now be made to exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

As noted above, lattice cutting machines have been developed, but some of these have a relatively slow operational rates. Some others that have been developed achieve higher speeds but present possible issues that affect the robustness of the design. For example, issues of noise, vibration and balance, and possible failure modes due to stretched or broken timing and drive belts at high operating speeds are among relevant concerns.

Advantageously, a lattice cutting machine has been developed that can rapidly and consistently cut potatoes and the like into lattice or waffle-cut slices of a desired slice thickness, and addresses some of the issues related to noise, vibration and balance, and possible failure modes that affect some prior lattice cutting machines. Shown in FIGS. 1-4 is an embodiment of a lattice cutting or slicing machine 110 in accordance with the present disclosure. This machine is configured for cutting products, particularly vegetable products, such as potatoes 112 (FIG. 2), into a plurality of lattice cut or waffle-cut slices of selected thickness. The cutting machine 110 includes an orbitally-driven lattice cutting plate 114 having multiple corrugated cutting or slicing knives 116. The knives 116 are configured to sequentially engage and cut each product into slices with a corrugated cut pattern on opposite sides of each slice, the corrugated patterns oriented at about right angles to each other. The thickness of each individual cut slice can be controlled so that the troughs associated with the corrugate pattern on opposing sides of the slice slightly intersect to form a pattern of small through openings in each cut slice.

Figure 2:
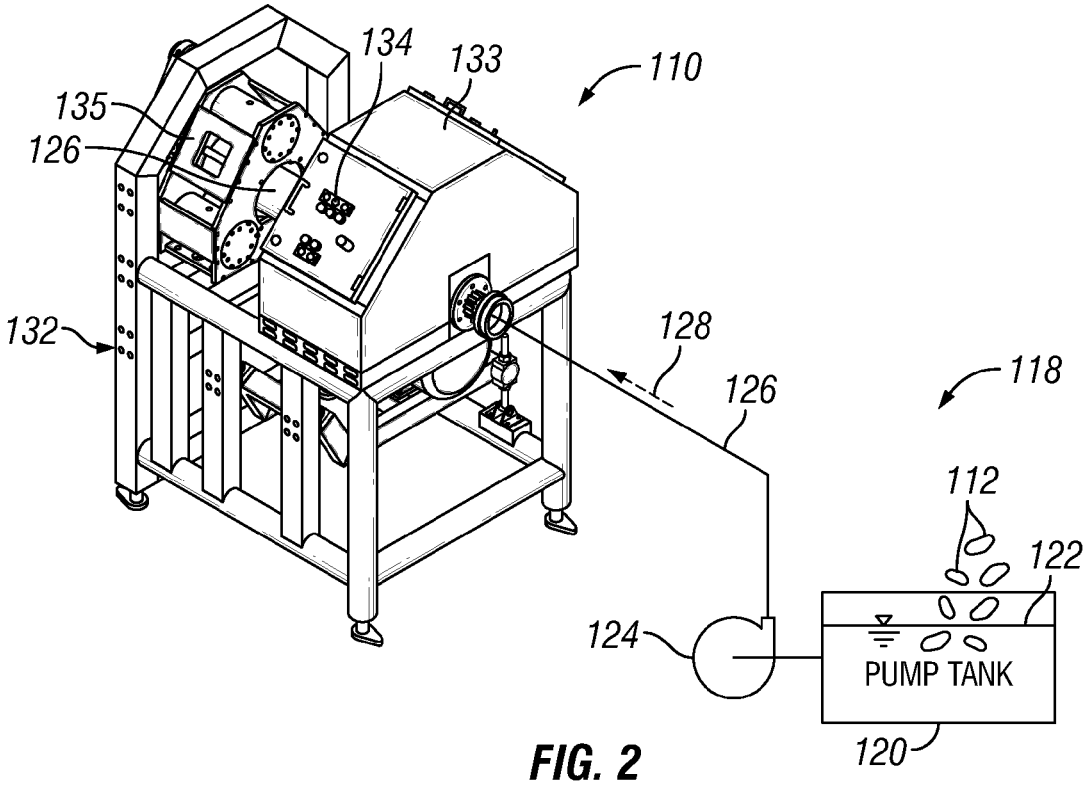
FIG. 2 is a rear perspective view of the lattice cutting machine of FIG. 1, showing.
Figure 3:
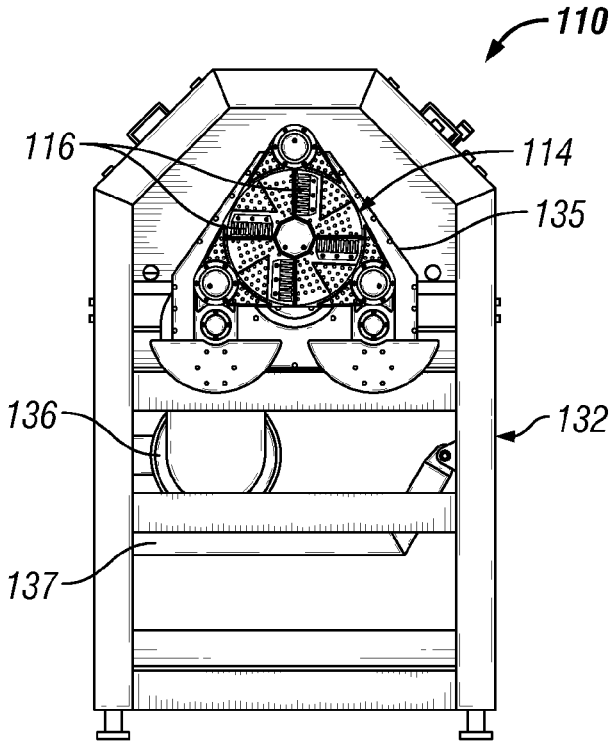
FIG. 3 is a front view of the lattice cutting machine of FIG. 1.
Figure 4:
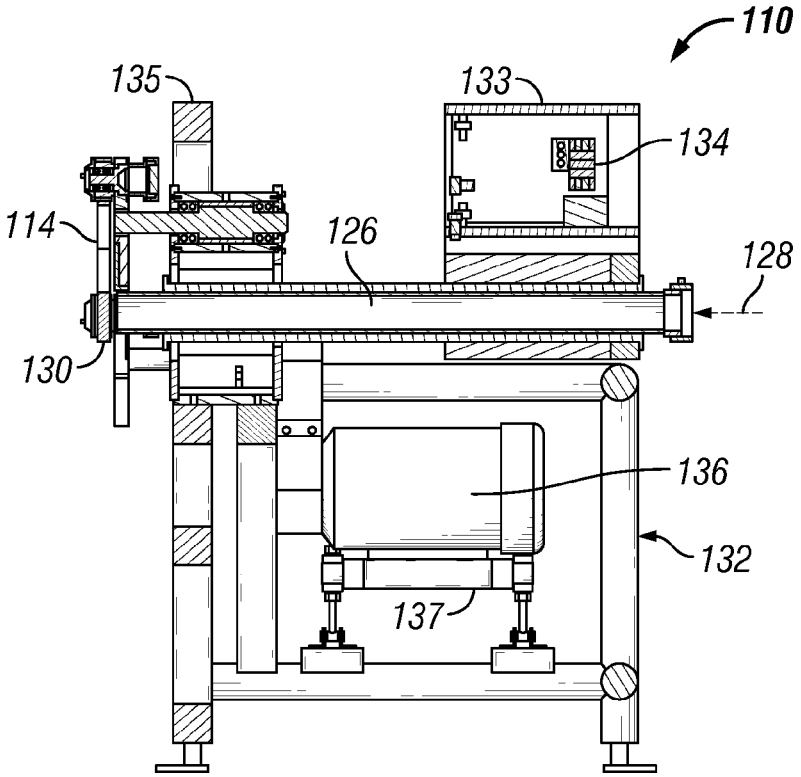
FIG. 4 is a side, cross-sectional view of the lattice cutting machine of FIG. 1.
Figure 5:
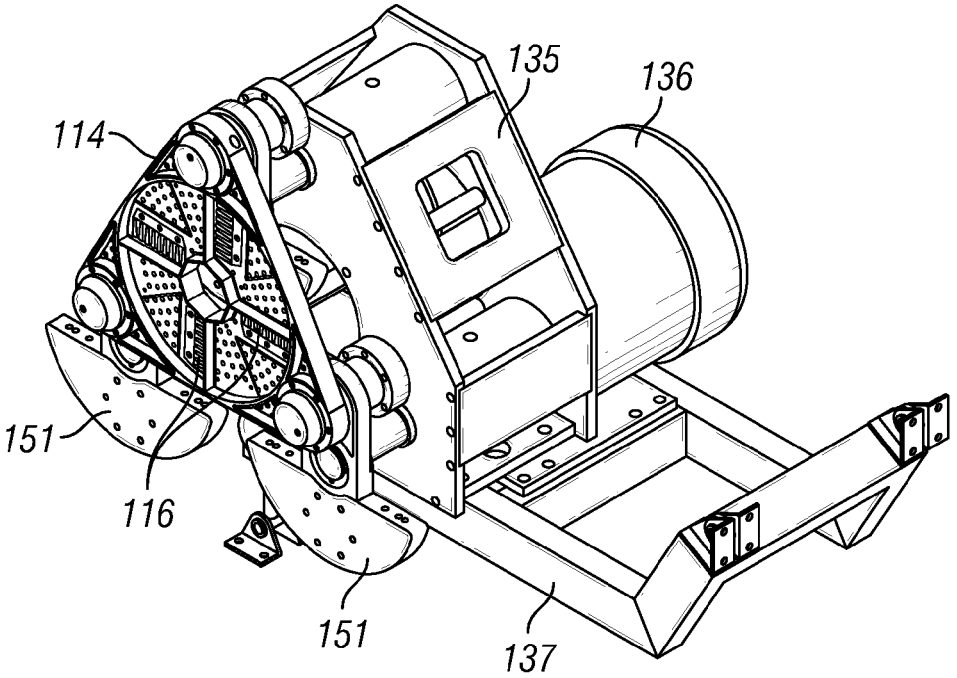
FIG. 5 is a partially disassembled, front perspective view of the cutting assembly of the lattice cutting machine of FIG. 1, showing the cutting plate and the drive motor.
Figure 6:
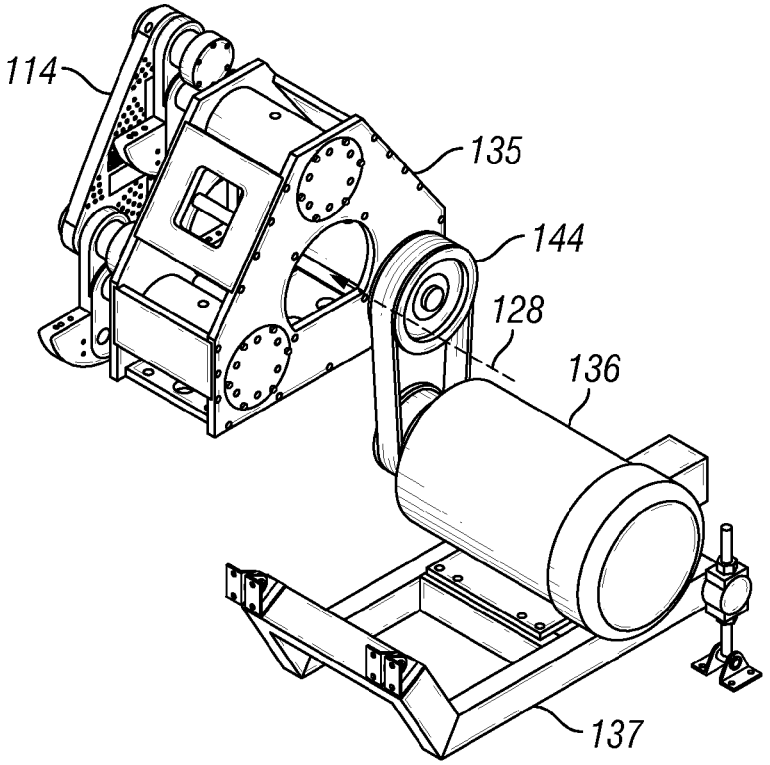
FIG. 6 is a partially disassembled, rear perspective view of the cutting assembly of the lattice cutting machine of FIG. 1, showing the cutting plate and the drive motor.
Figure 7:
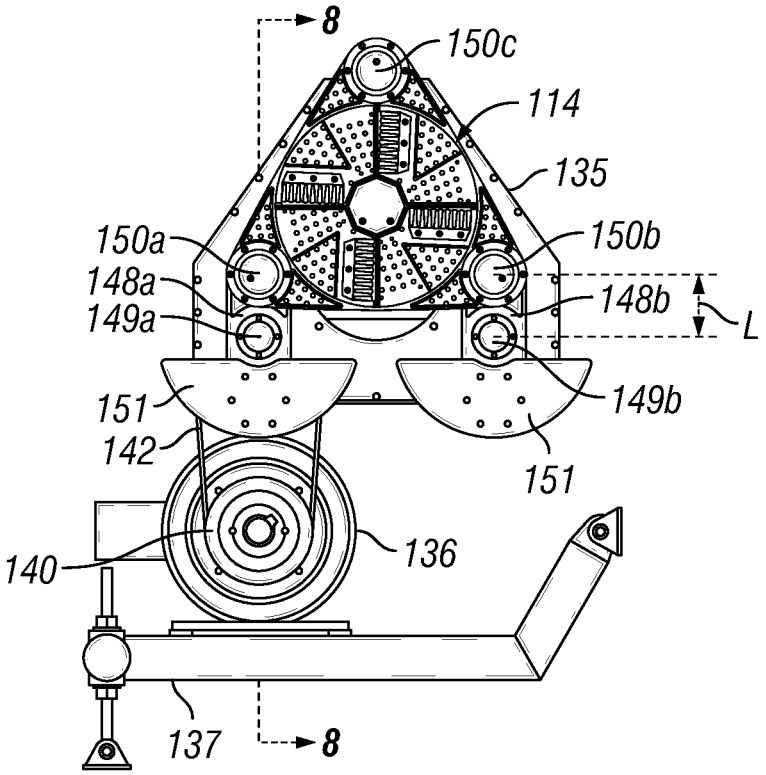
FIG. 7 is a front view of the cutting assembly of the lattice cutting machine of FIG. 1, showing the cutting plate and the drive motor.
Figure 8:
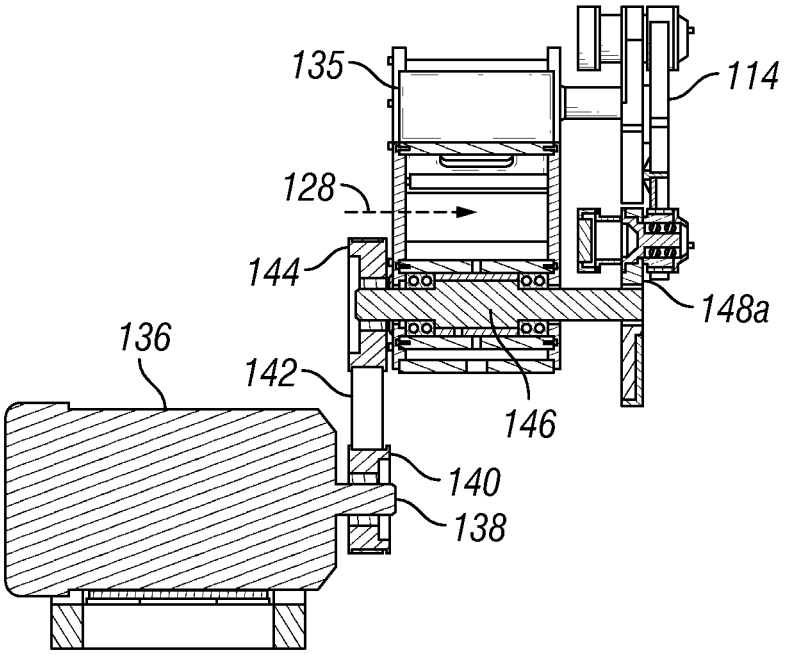
FIG. 8 is a side cross-sectional view of the drive motor and drive linkage of the lattice cutting machine of FIG. 1.
Figure 9:
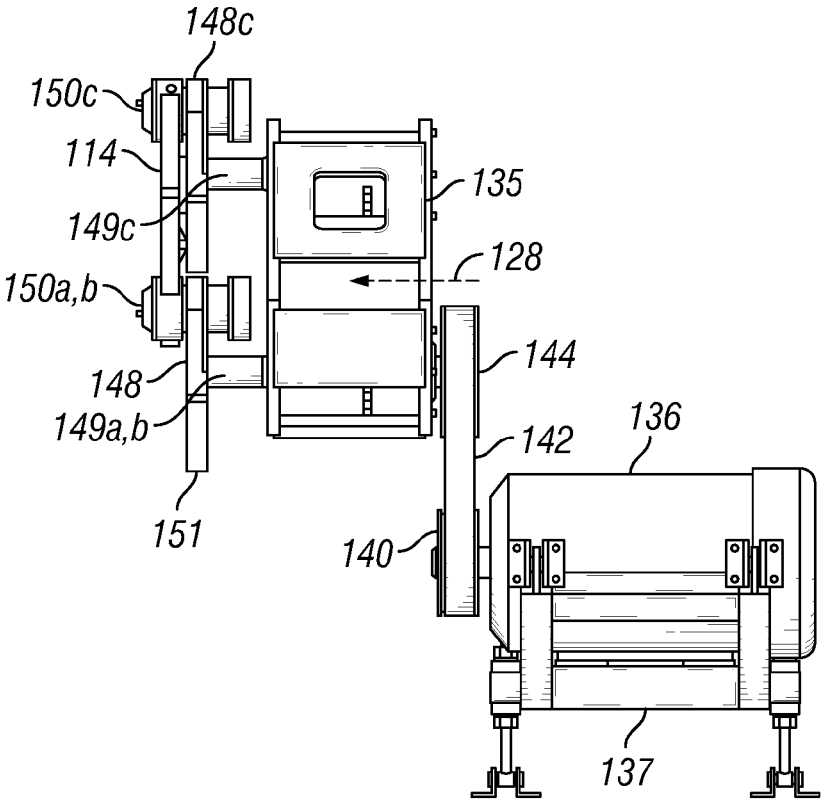
FIG. 9 is a side view of the drive motor and drive linkage of the lattice cutting machine of FIG. 1.

FIG. 2 includes some schematic elements that show the lattice cutting machine 110 in combination with a hydraulic feeding system 118, including a supply or pump tank 120 for receiving a quantity of potatoes 112 into a hydraulic fluid, such as water 122. As is known in the art, a suitable pump 124 or the like draws the hydraulic fluid 122 and the potatoes 112 and propels them single file and substantially without rotation at some selected velocity through a supply conduit 126. The supply conduit 126 defines a flow path 128 leading to a cutting position 130 of the lattice cutting machine 110. The tubular supply conduit 126 terminates within the cutting machine 110 approximately at the cutting position 130. Such hydraulic feed systems 118 are known in the art for use with so-called water knife systems, which are commonly used to rapidly cut potatoes or other products into elongated French fry strips suitable for subsequent production processing steps before shipment to a customer.

As shown in FIGS. 1-4, the cutting machine 110 generally comprises a support frame 132, which supports a portion of the supply conduit 126, and includes a control housing 133, which encloses system controls 134 and the like, and a drive housing 135, through which the terminal end of the supply conduit 126 extends. A drive motor 136 is attached to a motor mount 137, which is also attached to the frame 132. Additional views of the drive motor 136 and related structure are shown in FIGS. 5-9. The drive motor is configured to orbitally drive the lattice cutting plate 114 at a controlled rate of speed. As shown, the drive motor 136 includes a rotary output shaft 138 that is coupled to an output pulley 140, which is in turn coupled by a suitable drive or cog belt 142 to a driven pulley 144. Those of skill in the art will recognize that the relative speed of the drive pulley 140 and driven pulley 144 will depend on the relative diameter of these two pulleys.

The driven pulley 144 is coupled to an output shaft 146 that is supported by the drive housing 135, and rotatably drives a crank link 148*a*, which is one of three crank links 148*a-c*. The motor 136 can thus drive the cutting plate 114 at a selected rate of speed, depending on the speed of the motor 136. The rate of speed of the motor can be controlled via the system controls 134, based on product feed rate and other parameters. As shown in the figures, each of the crank links 148 are rotatably attached to the drive housing 135 at pivot points 149, and the distal end of each crank link 148 is also rotatably attached to one of three pivot points 150 of the lattice cutting plate 114. The crank links can each include counterweights 151 or the like for smooth rotational operation.

The length or distance L (FIG. 7) between the crank link pivot point 149 and cutting plate pivot point 150 of each crank link 148 is identical. In one embodiment, the distance L is 4 inches. An embodiment of the lattice cutting machine 110 has also been tested in which the distance L is 5 inches. Other lengths of the crank links 148 can also be used. By driving the first crank link 148*a*, the drive motor 136 thus drives the entire cutting plate 114 in an orbital motion through a generally circular path near the cutting position 130. This circular path is oriented in a plane that is generally perpendicular to a centerline of the product flow path 128. While the motor 136 drives only one of the three crank links 148, the other two crank links rotate in unison since they are connected to the first crank link via the cutting plate. This configuration does not include any additional timing belts, pulleys or other connections between the crank links, and thereby avoids mechanical issues that can arise with such structure. Concurrent rotation of all three crank links is achieved with the linkage through the cutting head alone.

Figure 10:
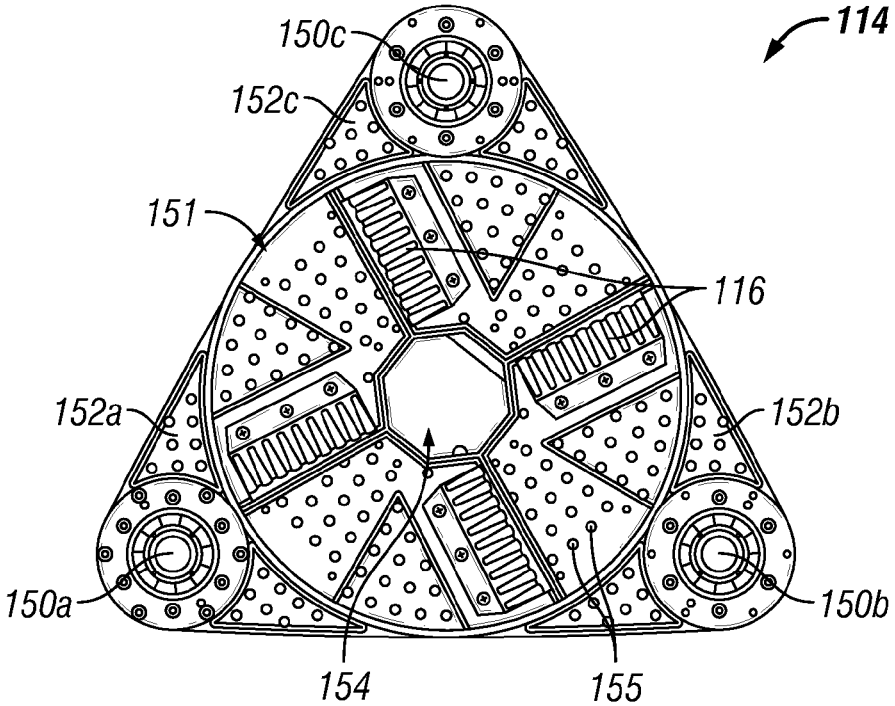
FIG. 10 is an enlarged front view of the cutting plate of the lattice cutting machine of FIG. 1.

As shown more particularly in FIG. 10, the lattice cutting plate 114 includes a generally circular cutting region 151 that is approximately centrally disposed within three extensions 152, which include the pivoting connections or pivot points 150 to the ends of the crank links 148. The lattice cutting plate 114 also includes a central aperture 154 formed therein to facilitate movement of the hydraulic fluid such as water 122 through the orbitally driven plate 114. In addition, if desired, the lattice cutting plate 114 can also include a plurality of small apertures 155 formed throughout the plate area for additional water relieving flow.

Figure 11:
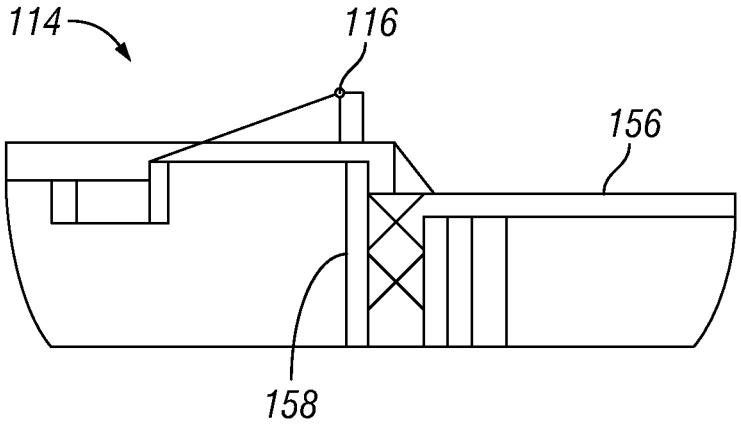
FIG. 11 is a cross-sectional view of a single cutter of the cutting plate of the lattice cutting machine of FIG. 1.

The lattice cutting plate 114 also carries multiple lattice or corrugated cutting knives 116, with four such knives being shown in the figures, supported on an upstream side of the cutting plate 114 in a generally equiangular array, whereby the knives 116 are oriented generally at intervals of about 90°. Each cutting knife 116 is further associated with a recessed ramp 156 (FIGS. 10-11) defined on the upstream side of the cutting plate 114 at a leading position relative to the associated knife 116 and the direction of cutting plate rotation. The ramps 156 can be formed as part of the cutting plate 114, or as a separate structure that is attached to the plate 114. As another alternative, each ramp can be associated with a knife assembly that includes the cutting knife 116. Each product (e.g. potato) in succession is driven by the hydraulic fluid 122 against the ramp 156, which guides the product 112 into cutting engagement with the associated cutting knife 116, with a cut slice traveling through a slot 158 (FIG. 11) in the cutting plate 114 associated with each of the knives 116. The specific angle of the ramps 156 together with the dimensions of the associated slots 58 affect slice thickness. Upon discharge through the respective slot 158, the slice proceeds downstream into a collection system, and can be taken on for dewatering and further production processing, such as blanching, parfrying and/or freezing. As an alternative to the ramps 156, other configurations for guiding the product into cutting engagement with each knife 116. For example, a slot of a selected size can be provided in the cutting plate 114 adjacent to each knife 116, allowing a next succeeding portion of the product to extend to a cutting position, at which the adjacent knife can cut a slice.

Figure 12:
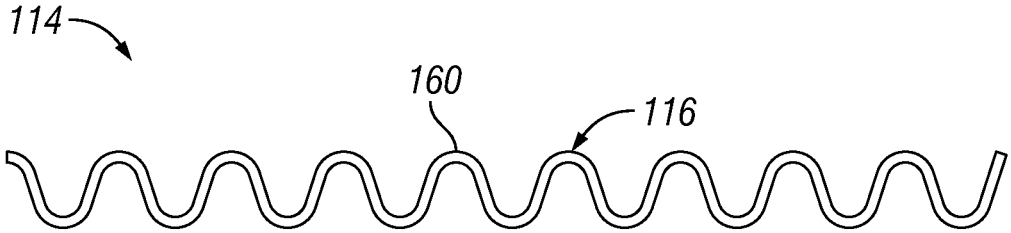
FIG. 12 is a cross-sectional view of a cutting blade of the lattice cutting machine of FIG. 1.

FIG. 12 shows one of the cutting knives 116 in end elevation to illustrate a cutting edge 160 thereof of generally corrugated shape. Each cutting knife 116 defines a peak and valley or trough configuration to form a corrugated peak-trough cut in the associated product such as a potato 112. In the embodiment shown in the figures, the multiple cutting knives 116 are identical, though it will be appreciated that cutting configurations with knives that are not all identical can also be used.

FIGS. 13-16 show one full revolution of the lattice cutting plate 114 relative to a hydraulically driven product such as a potato 112 in 90° increments to cut the product into lattice or waffle-cut slices. In these figures the outline of the drive housing 135, two of the crank link pivot points 149 and the cutting position 130 are shown in outline. Since these features do not move with respect to the cutting machine 110, their positions provide a fixed reference for observing the motion of the cutting plate 114. For clarity, the cutting knives are labeled as 116*a-d*. It will be recognized that the cutting knives 116*a-d* in FIGS. 13-16 are located slightly differently with respect to the cutting plate 114 compared to the cutting knives 116 shown in FIGS. 1, 3, 5 and 7. In FIGS. 10 and 13-16 the positions and orientations of the knives 116*a-d* are slightly different with respect to the cutting plate 114, but are still oriented generally perpendicular to each other. It is to be appreciated that the exact arrangement of the knives 116 relative to the cutting plate 114 can vary without affecting the operation of the cutting machine 110.

Each of the crank links 148 rotates in a clockwise direction, thus causing the cutting plate 114 to move in a clockwise orbital motion. Because of this motion, each cutting knife 116 passes across the cutting position 130 at an angle that is generally perpendicular to the direction of the pass of the immediately preceding knife. However, because the entire cutting plate 114 moves in an orbital motion, the orientation of the cutting knives does not rotate with respect to the cutting position 130. Thus the knives each pass across the cutting position in sequence in a curvilinear motion. Those of skill in the art will recognize that the radius of the curvilinear motion of the knives depends upon the length (L in FIG. 7) between the two pivot points 149, 150 on the crank links 148.

Figure 13:
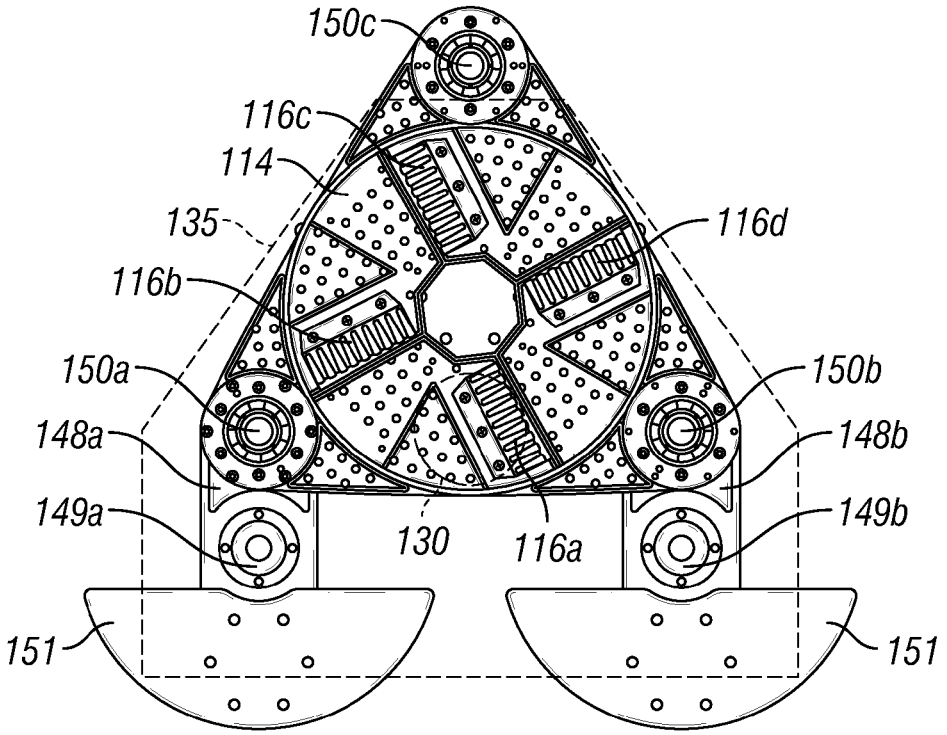
FIGS. 13-16 are front views of the lattice cutting machine of FIG. 1, showing the cutting plate in each of four positions during its oscillating cutting motion.

As shown in FIG. 13, in a first or initial rotational position, all three crank links 148 are positioned in an upwardly extending orientation (with respect to their pivot points 149), with the counterweights 151 oriented downward. In this initial position, the lowest one of the cutting knives 116*a* is positioned to move across the cutting position 30, and engage the product 112 in cutting engagement. Because of the clockwise direction of motion of the cutting plate 114, this motion of the lowest cutting knife 116*a* (moving left to right in the figure) forms a generally horizontal corrugated cut pattern on the product. It is to be appreciated that the terms "horizontal" and "vertical" as applied to the direction of cutting of the knives 116*a-d* in FIGS. 13-16 are only approximate, and are not used to suggest exactly horizontal or vertical motion. The slice that is cut in this motion is discharged from the cutting plate 114 in a downstream direction through the slot 158, and can drop into the collection system.

Figure 14:
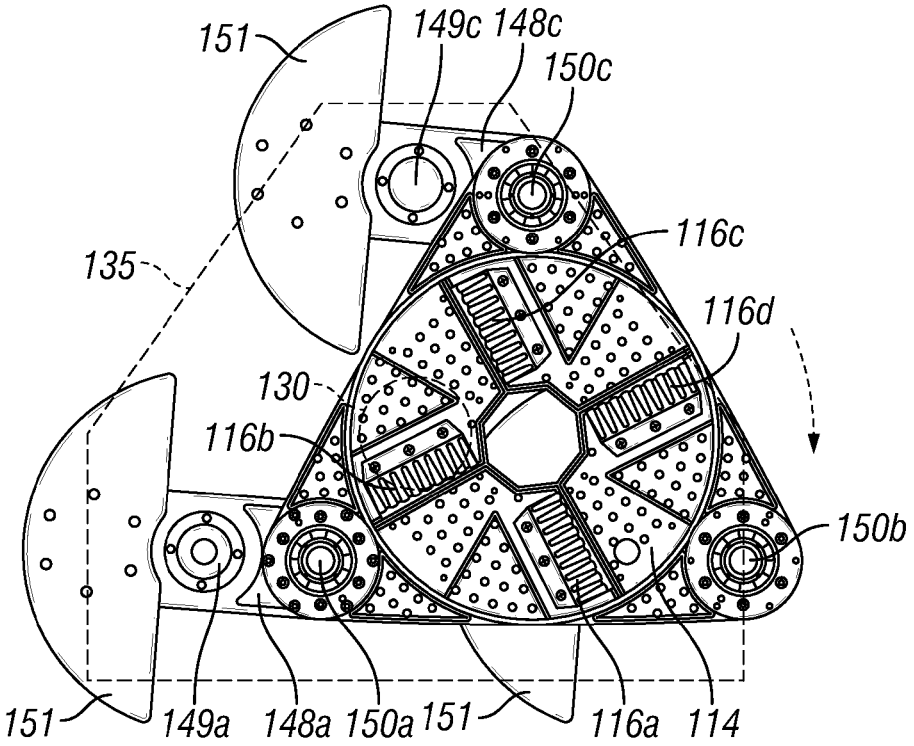

Moving to FIG. 14, as the crank links 148 rotatably advance in the clockwise direction through an angular displacement of about 90° (with the crank links 148 extending to the right relative to their pivot points 149 and the counterweights 151 to the left) the product 112 at the cutting position 130 enters the next ramp 156 for cutting engagement with the next knife 116*b* in succession. As can be seen from the figure, at this position the cutting knife is moving generally downwardly, and hence forms a generally vertical corrugated cut pattern on the product. Since this second cut pattern is oriented approximately at a right angle, or perpendicular to, the cut pattern immediately previously cut on the opposite side of the cut slice, the pattern of troughs and ridges on the opposing sides of the slice will be oriented at approximately right angles to each other, thus creating a lattice or waffle pattern. Depending on the overall thickness of the slice and the relative depth of the corrugations of the knives 116, the corrugation troughs of one side can intersect with the corrugation troughs of the other side, and create a lattice or waffle pattern with through holes in the opposing troughs.

Figure 15:
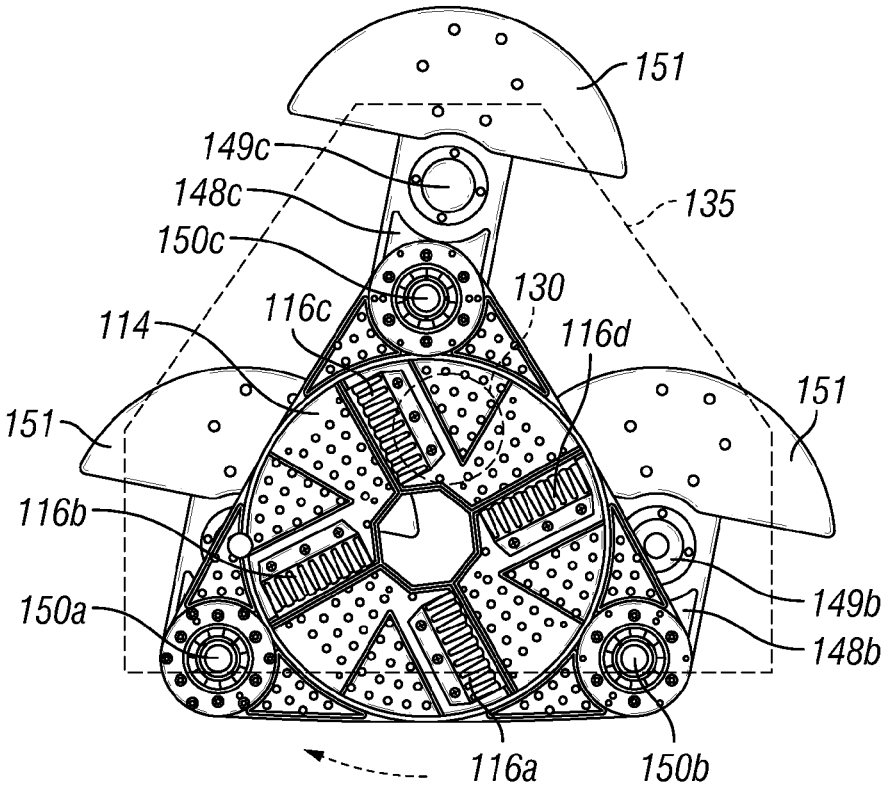

Viewing FIG. 15 the crank links 148 rotatably advance in the clockwise direction through another angular displacement of about 90°, so that the product 112 advances and engages the next ramp 156 in succession on the upstream side of the cutting plate 114. At this stage the crank links 148 are pointing down and the counterweights 151 are oriented upwardly. During this motion the next cutting knife 116*c* moves generally right to left across the cutting position 130, and thus forms a generally horizontally corrugated cut pattern on the product, and discharges the slice that is cut from the cutting plate 114 in a downstream direction through the slot 158. Again, since this cut pattern is oriented approximately at a right angle, or perpendicular to, the cut pattern immediately previously cut on the opposite side of the cut slice, the result is another slice having the lattice or waffle pattern on opposing sides.

Figure 16:
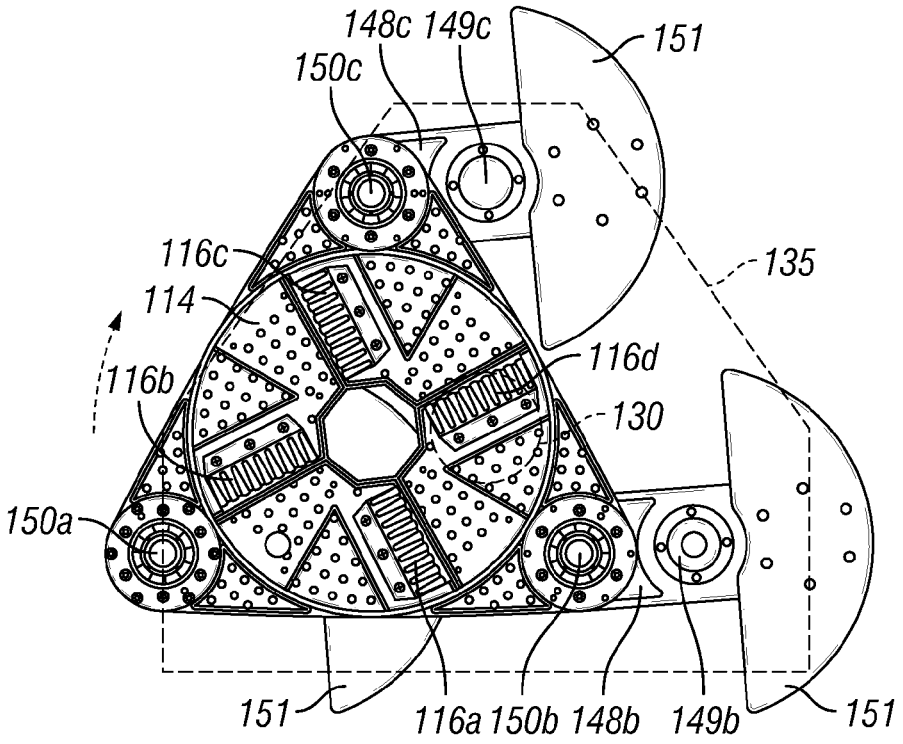

Finally, viewing FIG. 16, as the cutting plate 114 continues its orbital cycle, the crank links 148 rotatably advance in the clockwise direction through another angular displacement of about 90°, so that the product 112 advances and engages the next ramp 156 in succession on the upstream side of the cutting plate 114. At this stage the crank links 148 are pointing to the left and the counterweights 151 are oriented to the right. During this motion the next cutting knife 116*d* moves generally upwardly across the cutting position 130, and thus forms a generally vertically corrugated cut pattern on the product, and discharges the slice that is cut from the cutting plate 114 in a downstream direction through the slot 158. Again, this cut pattern is oriented approximately perpendicular to the cut pattern immediately previously cut on the opposite side of the cut slice, producing another slice having the lattice or waffle pattern on opposing sides.

Engagement with each cutting knife 116 thus creates a corrugated cut pattern in the product, while discharging a cut slice through the associated slot 158 for further production processing. Advantageously, each cut slice has the corrugated cut patterns on opposite sides thereof oriented at about right angles to each other.

By closely controlling the orbital rotational speed of the lattice cutting plate 114 in relation to the speed of travel of each product 112 along the hydraulic flow path 128, the individual thickness of each cut slice can be controlled. In this regard, the hydraulic fluid propelling each product 112 can be pumped at a sufficient mass flow rate to force each product against the ramps and into cutting engagement with the slicing knives 116 for a closely controlled slice thickness governed by the ramp geometry. In one operational example, the lattice cutting plate 114 is orbitally rotated at a speed of about 1,000 rpm, so that the four cutting knives 116 will make 4,000 cuts per minute as the cutting plate 114 is rotatably driven by the drive motor 136. With these parameters, the speed of travel of each potato 112 can be about 80 feet per minute (fpm) producing a cut slice thickness having a peak-to-peak dimension of about 0.50 inch. Alternative ramp configurations will, of course, result in alternative slice thicknesses. It will also be apparent that different operational ranges of cutting plate orbital speed and product flow rate can also be used. For example, with crank links 148 having a length L of 4 inches the cutting machine 110 has been operated at a speed of 1300 rpm. It is believed that operational speeds in the range of 500 to 1500 rpm are likely to be typical, and it is believed that faster speeds can also be used.

With a peak-to-peak cut slice thickness of about 0.50 inch, each of the cutting knives 116 carried by the lattice cutting plate 114 can have a trough or valley depth dimension that is slightly greater than ½ the slice thickness. With this geometry, when the two corrugated cut patterns are formed on opposite sides of each cut slice, the troughs of the two patterns at least slightly intersect to form a pattern of small openings in each cut slice. In one embodiment, the height dimension of each cutting knife 116 is selected to be about 0.30 inch, to form small openings having a generally rectangular dimension of about 0.20 inch by about 0.20 inch with a peak-to-peak cut slice thickness of about 0.50 inch.

A variety of modifications and improvements in and to the lattice cutting machine 110 of the present invention will be apparent to those skilled in the art. As one example, the specific number of slicing knives 116 on the cutting plate 114 can vary, with corresponding change in the product throughput rate. As another example, the thickness of each cut slice can be selected in relation to knife geometry so that the corrugated troughs defined by the slicing knives 116 do not intersect and thus do not form cut slices including a pattern of small holes. Other variations can also be used.

Another advantageous feature of the lattice cutter disclosed herein is that this cutter can be fed using a mechanical system, in addition to the hydraulic system shown and described. For example, the product can be conveyed into the cutter using belts or chains. Additionally, the cutter can be oriented so that product flow is downward (either vertical or at an angle), so that product can be dropped or slid into the cutter. Thus the lattice cutter can be fed hydraulically, mechanically, or by gravity, or any combination of these.

Figure 17:
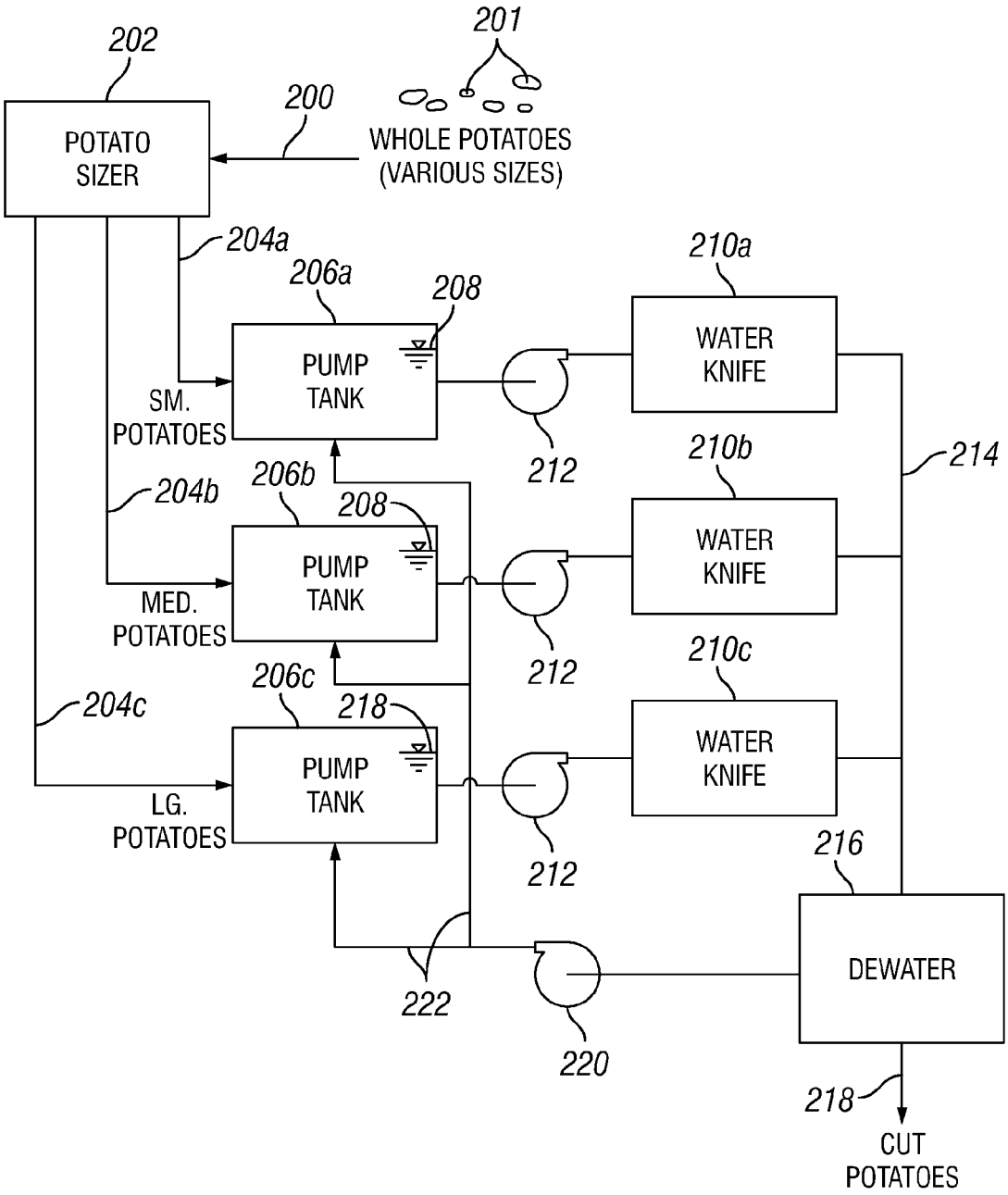
FIG. 17 is a diagram of a system for simultaneously employing multiple water knives in parallel.
Figure 18:
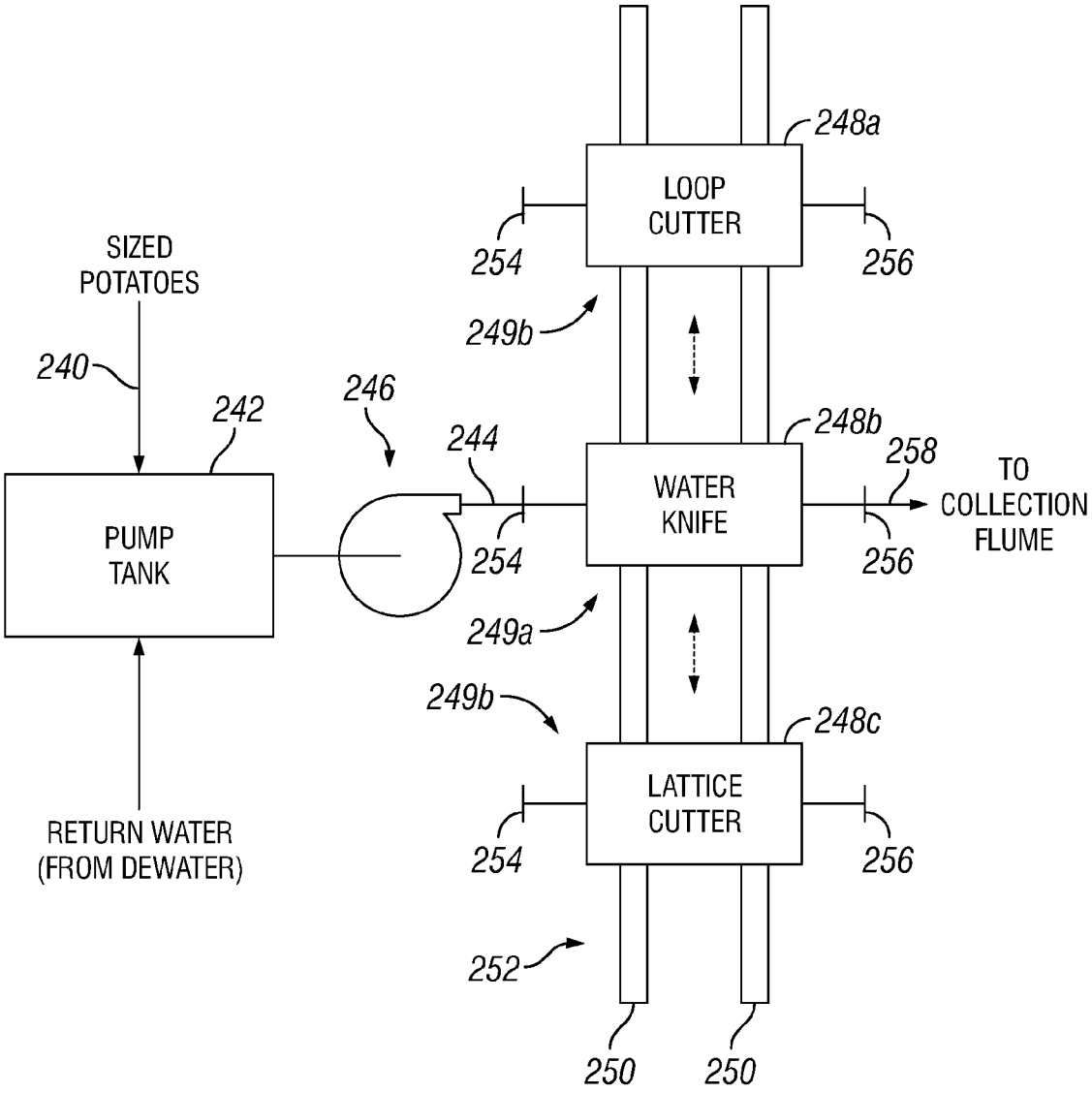
FIG. 18 is a diagram of a system for selectively employing multiple slicing machines which are moveably mounted upon a track system.
Figure 19:
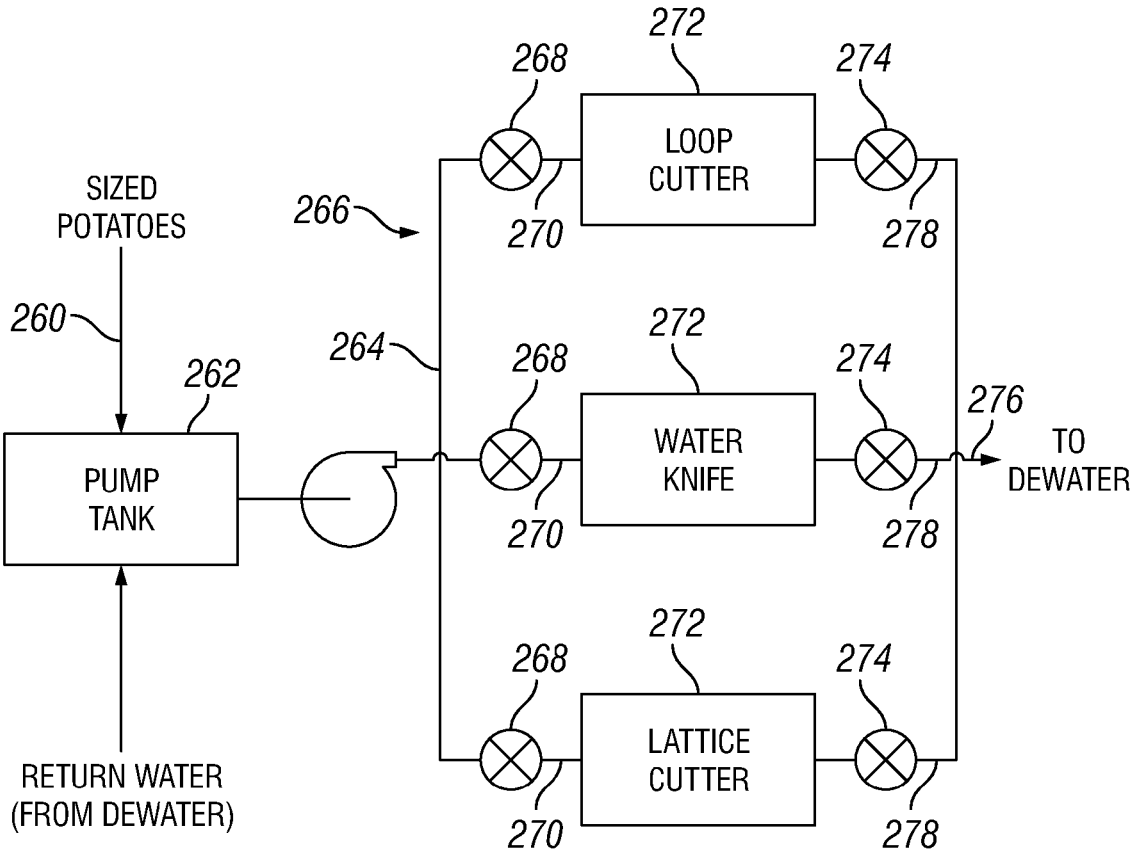
FIG. 19 is a diagram of a system for selectively employing multiple slicing machines in parallel via selective adjustment of valves in a water transport system.

The lattice cutting system depicted in FIGS. 1-16 and described above can be incorporated into various systems for transporting and controlling products to be cut. Several embodiments for such systems are shown in FIGS. 17-19. Each of these systems include a transport system that is configured for transporting vegetable products in single file toward an outlet, and a plurality of vegetable cutting machines positioned at the outlet(s). These systems also include a selection device that is configured to selectively couple the outlet of the transport system to one or more of the vegetable cutting machines. Such systems can allow for easy variation of cutting methods, and/or for easier selection of system components and taking certain components off line for cleaning, maintenance, etc.

Shown in FIG. 17 is a diagram of a system for simultaneously employing multiple water knives in parallel for cutting potatoes. This system generally includes an input stream 200 of whole potatoes 201 of various sizes, which are first fed into a potato sizing machine 202, which segregates the potatoes 201 by size, and selectively discharges them into any one of multiple transport conduits 204*a-c*. The potato sizing machine 202 in this embodiment operates as a selection device. Each of the transport conduits 204 lead to a pump tank 206, which stores the potatoes 201 in a hydraulic fluid 208 (e.g. water) in preparation for feeding into the respective water knife cutting machine 210. Each pump tank 206 is connected to a pump 212, which pumps the hydraulic fluid 208 with the potatoes 201 in single file, to a unique water knife cutting machine 210. In a three machine water knife system, as shown, the potatoes 201 are sorted into small, medium and large sizes, and conveyed to three water knife cutting machines 210 of different sizes. Three and four cutting machine systems are common, and other numbers of machines can be used.

The system of FIG. 17 also includes a collection system, disposed downstream of the vegetable cutting machines, configured to collect the vegetables after cutting. Specifically, following cutting by the respective cutting machines 210, the potatoes 201 enter a common collection flume 214 which leads to a dewatering machine 216. Those of skill in the art will be aware that food product collection systems often collect product on a conveyor belt, in a flume, or on a vibratory conveyor. Mesh belt conveyors, fixed screens, or vibratory conveyors are frequently used to dewater. The dewatering machine separates the hydraulic fluid (e.g. water) from the potato slices, and discharges the cut and dewatered potato slices in one stream 218 (e.g. on a conveyor belt or chain) and returns the water to the pump tanks 206 via a pump 220 and return water lines 222.

Shown in FIG. 18 is a diagram of another system for selectively employing multiple slicing machines, in which the selection device is a cutting machine transport device that selectively moves one of multiple cutting machines into an operating position. In this configuration, a stream 240 of sized potatoes is provided to a pump tank 242, then pumped toward an outlet 244 of the single transport system 246. Multiple slicing machines 248 are moveably mounted upon rails 250 of a track system 252. The track system 252 is the cutting machine transport device, upon which the plurality of vegetable cutting machines 248 are mounted. The system is configured to selectively move any one of the plurality of vegetable cutting machines 248 between an active position 249*a* in communication with the outlet 244 of the transport system 246, and one or more inactive positions, indicated at 249*b*.

Each cutting machine 248 includes a releasable coupler 254 at its inlet end, configured for selectively releasably connecting the respective vegetable cutting machine 248 to the outlet 244 of the transport system 246. Each cutting machine 248 also includes a releasable coupler 256 at its outlet end, configured for selectively releasably connecting the respective vegetable cutting machine 248 to the inlet of a collection system or collection flume 258, disposed downstream of the vegetable cutting machines 248. As discussed above, the collection system 258 is configured to collect the vegetable slices after cutting, and can lead to a dewatering system, etc.

In the system of FIG. 18 the cutter 248 that is desired for a particular product can be rolled into place upon the rails 250 and quickly connected to the transport system 246 and collection system 258 with the releasable couplings 254, 256. This configuration allows multiple types of cutting machines, such as loop and lattice cutters, to be added to a water knife system via the track system 252. This can allow rapid selection and switching between the different types of machines, and can also make it easier to take one machine off line for cleaning or maintenance.

Another approach is shown in FIG. 19, which provides a diagram of a system for selectively employing multiple slicing machines in parallel via selective adjustment of valves in a water transport system. In this embodiment, a stream 260 of sized potatoes is provided to a pump tank 262, then pumped toward an outlet 264 of the single transport system 266. In this embodiment, rather than moving different cutting machines to an operating position, the cutters are stationary and product is directed to and from the desired cutter by opening or closing valves in a piping system. Specifically, the selection device in this system includes a plurality of transport valves 268, disposed in communication with the outlet 264 of the transport system 266, and a plurality of transport extensions 270, each extending from one of the plurality of transport valves 268 to one of the plurality of vegetable cutting machines 272. This arrangement can be used for selectively switching between the use of multiple cutting machines of different types. It could also be used for simultaneously employing multiple cutting machines of the same type at the same time. Other uses may also be possible.

The system shown in FIG. 19 also includes a plurality of collection valves 274, each disposed in a collection system 276 downstream of the vegetable cutting machines 272. A plurality of collection system extensions 278 extend from each one of the collection valves 274 to a common portion of the collection system 276. As discussed above, the collection system 276 can be configured to collect the vegetable slices after cutting, and can lead to a dewatering system, etc. With this system, selecting between the different cutting machines 272 is fast, and product damage can be reduced or avoided by selecting large radius elbows 274 in the product transport extension conduits 270. Conduits can also be relocated to form the flow paths and valves omitted. For example, the flow paths can be assembled as needed from pipe components and quick connectors without the need for valves. This option can help reduce the risk of product damage due to contact with the internal components of valves.

It is to be understood that the above-referenced arrangements are illustrative of the application of the principles of the present invention. It will be apparent to those of ordinary skill in the art that numerous modifications can be made without departing from the principles and concepts of the invention as set forth in the claims.

What is claimed is:

1. A cutting machine for cutting a vegetable product, comprising:

a frame, supporting a product flow path to a cutting position;

at least three links, each of the at least three links having a first end that is pivotally attached to the frame at a first pivot point, and a second end;

a cutting plate, pivotally attached to at least three pivot points at the second ends of each of the at least three links, and oriented substantially perpendicular to the flow path;

a plurality of cutting knives, carried by the cutting plate in a fixed orientation, each knife having a corrugated configuration defining adjacent peaks and troughs, the cutting knives oriented angularly with respect to each other; and a drive motor, coupled to rotationally drive the first end of at least one link of the at least three links about the first pivot point thereof with respect to the frame, whereby the cutting plate moves in a plane substantially perpendicular to the flow path, in an orbital motion with a fixed angular orientation through a generally circular path at the cutting position, wherein the fixed orientation of the cutting knives does not rotate with respect to the at least three second pivot points, thereby moving the cutting knives sequentially and repeatedly across the product flow path.

2. A cutting machine in accordance with claim 1, wherein the cutting plate further comprises:

a plurality of recessed ramps, each positioned at an upstream side of each cutting knife, configured for guiding the product into cutting engagement with the respective cutting knife; and a plurality of slots, each positioned at a downstream side of each cutting knife, configured for passage of each cut slice therethrough.

3. A cutting machine in accordance with claim 1, wherein the cutting plate includes four cutting knives disposed at approximately 90° intervals, and oriented substantially perpendicular to each successive cutting knife.

4. A cutting machine in accordance with claim 1, wherein each of the cutting knives has a trough dimension greater than ½ the peak-to-peak dimension of each cut slice, whereby each cut slice has a regular pattern of small holes formed therein to define lattice cut slices.

5. A cutting machine in accordance with claim 1, wherein the cutting plate further comprises a plurality of apertures extending therethrough, configured for flow-through passage of an hydraulic fluid.

6. A cutting machine in accordance with claim 1, wherein the vegetable product comprises potatoes.

7. A cutting machine in accordance with claim 1, wherein an orbital speed of the cutting plate and a feed rate of product along the product flow path are selectable to produce cut slices having a selected peak-to-peak thickness.

8. A cutting plate for cutting vegetables, comprising:

a plurality of cutting blades, disposed radially upon the cutting plate in a fixed orientation, each cutting blade having a corrugated cutting profile and configured to cut a vegetable slice with a pattern of adjacent peaks and troughs;

a corresponding plurality of slots, adjacent to each cutting blade, the slots configured to allow the vegetable slice to pass through after being cut by one of the plurality of cutting blades; and a plurality of rotatable links, pivotally connected to the cutting plate at a plurality of first pivot points, the links configured to link the cutting plate to a driving device that rotates one of the links about a second pivot point distal from the first pivot point thereof, thereby moving the cutting plate in a plane in an orbital motion in a generally circular path, wherein the fixed orientation of the cutting blades does not rotate with respect to the plurality of first pivot points, adjacent to a cutting position for the vegetables.

9. A cutting plate in accordance with claim 8, further comprising a ramp adjacent to each cutting blade, the ramps being configured to control the thickness of the vegetable slices cut by the cutting blades.

10. A cutting plate in accordance with claim 8, wherein the cutting plate comprises four cutting blades.

11. A cutting plate in accordance with claim 10, wherein the four cutting blades are oriented at approximately right angles with respect to each other.

12. A cutting plate in accordance with claim 8, wherein the plurality of rotatable links comprises at least three rotatable links.

13. A cutting machine for cutting vegetables, comprising:

a product flow path, configured to direct the vegetables to a cutting position;

a cutting plate, pivotally mounted upon distal ends of three rotatable links at the cutting position, and oriented generally perpendicular to the product flow path;

four cutting knives, fixedly disposed upon the cutting plate at approximately 90° intervals and oriented substantially perpendicular with respect to each adjacent cutting knife, each of the cutting knives having a fixed angular orientation;

a corrugated configuration defining adjacent peaks and troughs;

an upstream side, having a recessed ramp for guiding the vegetables into cutting engagement with the cutting knife; and a downstream side, having a slot for passage of each cut slice therethrough after cutting; and means for rotationally driving a proximal end of at least one of the links, thereby driving the cutting plate in an orbital motion through a generally circular path with a fixed angular orientation in a plane generally perpendicular to the flow path at the cutting position, wherein the fixed orientation of the cutting knives does not rotate with respect to the proximal or distal ends of the links, whereby the cutting knives sequentially and repeatedly move across the cutting position and into cutting engagement with the vegetables to form vegetable slices having a corrugated cut shape.

* * * * *